US005176568A

United States Patent [19]

Nagatomo et al.

[11] Patent Number: 5,176,568

[45] Date of Patent: Jan. 5, 1993

[54] BLOWING DIRECTION CONTROL DEVICE FOR AN AIR CONDITIONER

[75] Inventors: Hideaki Nagatomo; Kazuaki Isono; Toshihiro Tanaka; Hidenori Ishioka; Katsuyuki Aoki; Seiji Kubo; Yasuo Imaki; Isao Funayama, all of Shizuoka, Japan

[73] Assignee: Mitsubishi Denki Kabushiki Kaisha, Tokyo, Japan

[21] Appl. No.: 855,547

[22] Filed: Mar. 20, 1992

[30] Foreign Application Priority Data

Mar. 25, 1991 [JP] Japan ..... 3-059282

[51] Int. Cl.[5] ..... F24F 13/15

[52] U.S. Cl. ..... 454/285

[58] Field of Search ..... 454/153, 155, 313, 314, 454/315, 319, 320, 285

[56] References Cited

U.S. PATENT DOCUMENTS 3,330,202 7/1967 Colle ..... 454/285
4,653,384 3/1987 Amano ..... 454/319
5,072,657 12/1991 Sakai ..... 454/285 X

FOREIGN PATENT DOCUMENTS 61-265442 11/1986 Japan .
63-26047 2/1988 Japan .
1-212855 8/1989 Japan .

*Primary Examiner*—Harold Joyce
*Attorney, Agent, or Firm*—Oblon, Spivak, McClelland, Maier & Neustadt

[57] ABSTRACT

There are provided a plurality of groups 14 and 34 which are arranged in an outlet of a main body, and which comprise blowing direction deflecting plates 1, 2 and 3, and 21, 22 and 23; rotational angle setting means 41*a* and 41*b* which are provided for the respective groups 14 and 34, and which set rotation angles of the groups 14 and 34; rotational angle limit detection means 42*a* and 42*b* for comparing preset limiting rotation angles of the groups 14 and 34 to the set rotation angles; and rotational direction reversing means 43 for reversing the rotational directions of the groups 14 and 34 when at least one of the groups 14 and 34 has reached the limiting rotation angle. Blowing direction of conditioned air can be adjusted while constantly keeping an arbitrary phase difference in blowing direction between the groups.

2 Claims, 5 Drawing Sheets

BLOWING DIRECTION CONTROL DEVICE FOR AN AIR CONDITIONER

The present invention relates to a blowing direction control device for an air conditioner which has an air outlet provided with a plurality of groups comprising blowing direction deflecting plates.

Referring now to FIG. 5, there is shown a conventional device for controlling blowing direction of conditioned air in the horizontal direction in an air conditioner indoor unit, which has been disclosed in e.g. Japanese Unexamined Patent Publication No. 265442/1986. In FIG. 5, reference numerals 1, 2 and 3 designate blowing direction deflecting plates. Reference numerals 4, 5 and 6 designate pivotal shafts of the blowing direction deflecting plates The blowing direction deflecting plates 1, 2 and 3 are coupled to a connecting member 7 through connecting pins 8, 9 and 10, respectively. When a torque is transmitted from an electric motor 11 to the pivotal shaft 4, the blowing direction deflecting plates rotate in the same direction about their pivotal shafts 4, 5 and 6. Reference numeral 12 designates a first orientation member. Reference numeral 13 designates a second orientation member. The members 1–13 constitute a first group 14 which includes the blowing direction deflecting plates. Similarly, reference numerals 21, 22 and 23 designate blowing direction deflecting plates. Reference numerals 24, 25 and 26 designate pivotal shafts of the blowing direction deflecting plates. The blowing direction deflecting plates 21, 22 and 23 are coupled to a connecting member 27 through connecting pins 28, 29 and 30, respectively. When a torque is transmitted from an electric motor 31 to the pivotal shaft 26, the blowing direction deflecting plates rotate in the same direction about their pivotal shafts 24, 25 and 26. Reference numeral 32 designates a third orientation member. Reference numeral 33 designates a fourth orientation member The members 21–33 constitute a second group 34 which includes the blowing direction deflecting plates 21–23.

The operation of the conventional device will be described. In the first group 14, an angle at which the blowing direction deflecting plates 3 contacts with the first orientation member 12 is called a reference position. When the blowing direction deflecting plates 1, 2 and 3 rotate in the direction opposite to an arrow in FIG. 5 by the torque from the electric motor 11, and the blowing direction deflecting plate 3 contacts with the firstg orientation member 12, the electric motor 11 stops rotating. On the other hand, an angle at which the blowing direction deflecting plate 1 contacts with the second orientation member 13 is called a maximum rotation angle. When the blowing direction deflecting plates 1, 2 and 3 rotate in the direction indicated by the arrow in FIG. 5 by the torque from the electric motor 11, and the blowing direction deflecting plate 1 contacts with the second orientation member 13, the electric motor 11 stops rotating. Similarly, in the second group 34, an angle at which the blowing direction deflecting plate 21 contacts with the third orientation member 32 is called a reference position. When the blowing direction deflecting plates 21, 22 and 23 rotate in the direction indicated by an arrow in FIG. 5 by the torque from the electric motor 31, and the blowing direction deflecting plate 21 contacts with the third orientation member 32, the electric motor 11 stops rotating. On the other hand, an angle at which the blowing direction deflecting plate 23 contacts with the fourth orientation member 33 is called a maximum rotation angle. When the blowing direction deflecting plates 21, 22 and 23 rotate in the direction opposite to the arrow in FIG. 5 by the torque from the electric motor 31, and the blowing direction deflecting plate 23 contacts with the fourth orientation member 33, the electric motor 11 stops rotating.

Air flow control is important to an increase in comfort in heating. A wide range of blowing direction setting is required in accordance with conditions. For example, in order that hot air reaches a user's feet to positively warm the feet, a phase difference $\Delta\theta a$ is set so that diffused air flows are contracted as shown in FIG. 6. In order to decrease a feeling of air flow, a phase difference $\Delta\theta b$ is set so that diffused air flows spread as shown in FIG. 7. When as shown in FIG. 5 the blowing direction of the first group 14 and that of the second group 34 are adjusted in the same direction as indicated by the arrows while keeping a phase difference $\Delta\theta$ in the conventional device constructed as stated earlier, a problem is created as follows: The first group 14 stops when the blowing direction deflecting plate 1 contacts with the second orientation member 13. However, because information on it is not transmitted to the second group 34, the second group continues to further rotate until the blowing direction deflecting plate 21 contacts with the third orientation member 32. As a result, the phase difference $\Delta\theta$ is shortened to prevent the blowing direction of conditioned air from being directed to a target. The conventional device also creates another problem as follows: When the blowing direction of conditioned air.is extremely deflected in cooling, the blowing direction deflecting plates have negative pressure caused on their rear surfaces to entangle ambient air having high relative humidity. A temperature difference between diffused cooled air and the entangled ambient air causes dew to be formed around the outlet. The limitative blowing direction in heating is required to correspond to the blowing direction wherein no dew is formed in cooling, which means that a variable range of the blowing direction is restricted.

It is an object of the present invention to solve these problems, and to provide a blowing direction control device capable of ad3usting the blowing direction of conditioned air while keeping an arbitrary phase difference in blowing direction between a plurality of blowing direction deflecting plate groups, and capable of setting a suitable blowing direction limit in accordance with operating conditions.

The foregoing and other objects of the present invention have been attained by providing a plurality of groups which are arranged in an outlet of a main body, and which comprise blowing direction deflecting plates; rotation angle setting means which are provided for the respective groups and which set rotation angles of the groups; rotation angle limit detection means for comparing preset limiting rotation angles of the groups to the set rotation angles; and rotational direction reversing means for reversing the rotational directions of the groups when at least one of the groups has reached the limiting rotation angle.

The blowing direction control device in accordance with the present invention can further comprise limiting rotation angle storing means for storing a plurality of limiting rotation angles.

Now, the present invention will be described in detail with reference to preferred embodiments illustrated in the accompanying drawings.

Figure 1:
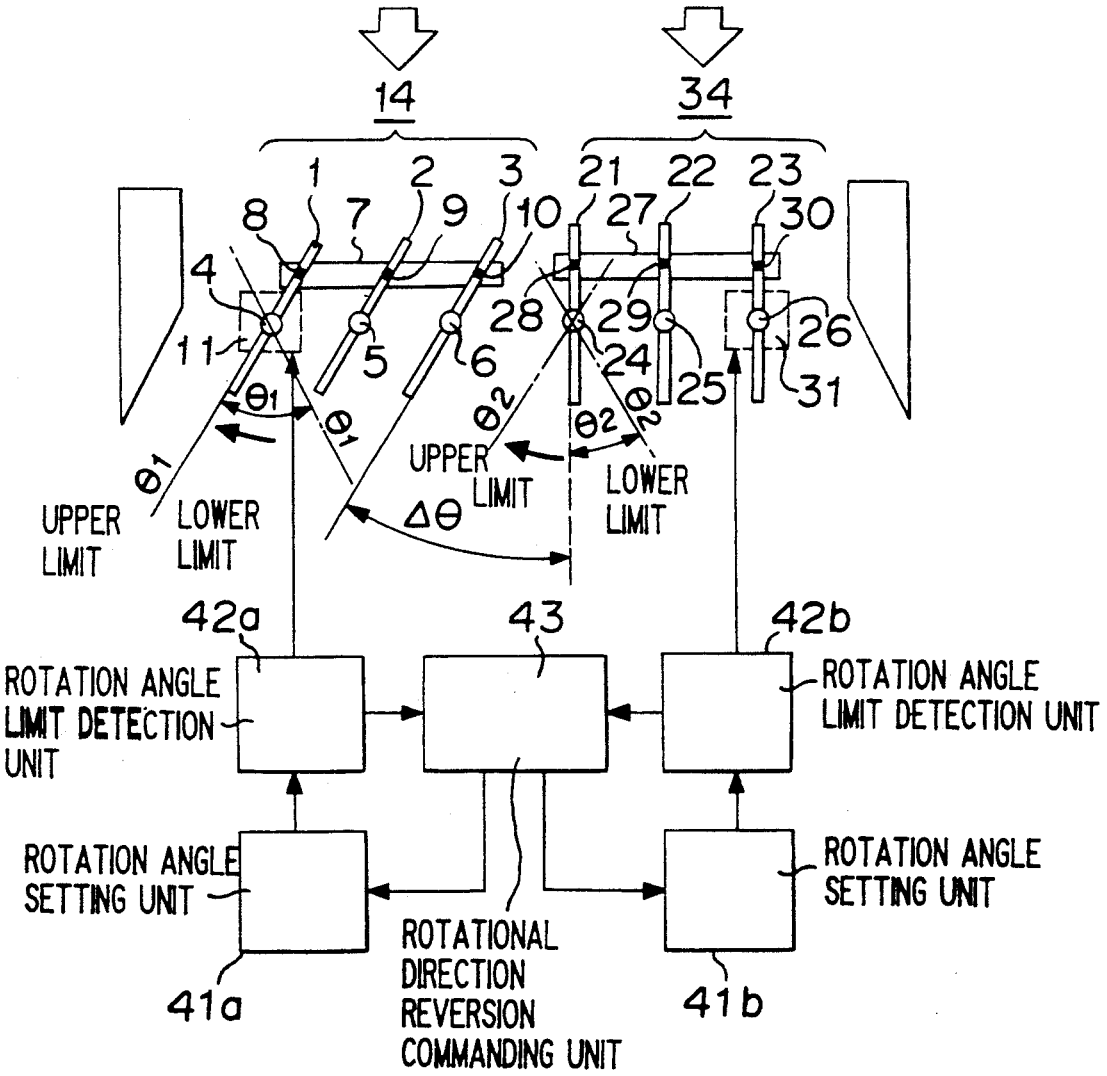
FIG. 1 is a schematic diagram showing the blowing direction control device according to a first embodiment of the present invention.
Figure 5:
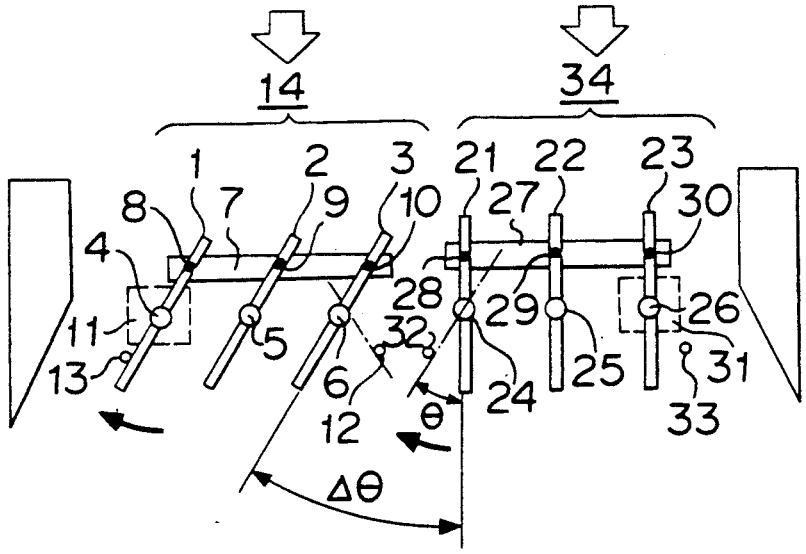
FIG. 5 is a schematic.diagram showing a conventional blowing direction control device.

EMBODIMENT 1:

The device for controlling the blowing direction of conditioned air in the horizontal direction in an air conditioner indoor unit in accordance with a first embodiment of the present invention will be described, referring to the drawings. In FIG. 1, reference numeral 41*a* designates a first rotation setting unit which sets the blowing direction of a first group 14 of blowing direction deflecting plates 1, 2 and 3. Reference numeral 41*b* designates a second rotation angle setting unit which sets the blowing direction of a second group 34 of blowing direction deflection plates 21, 22 and 23. Reference numeral 42*a* designates a first rotation angle limit detection unit which compares the set rotation angle of the first group 14 to a limit rotation angle. Reference numeral 42*b* designates a second rotation angle limit detection unit which compares the set rotation angle of the second group 34 to a limit rotation angle. Reference numeral 43 designates a rotational direction reversion commanding unit which outputs a rotational direction reversion command to the rotation angle setting unit 41*a* and the rotation angle setting unit 41*b* when the first rotation angle limit detection unit 41*a* or the second rotation angle limit detection unit 41*b* detects that the set rotation angle has reached the limit rotation angle. The structures and the relations of other parts are identical or corresponding to those indicated by the same reference numerals in FIG. 5, and explanation of these parts will be omitted for the sake of simplicity.

Figure 2:
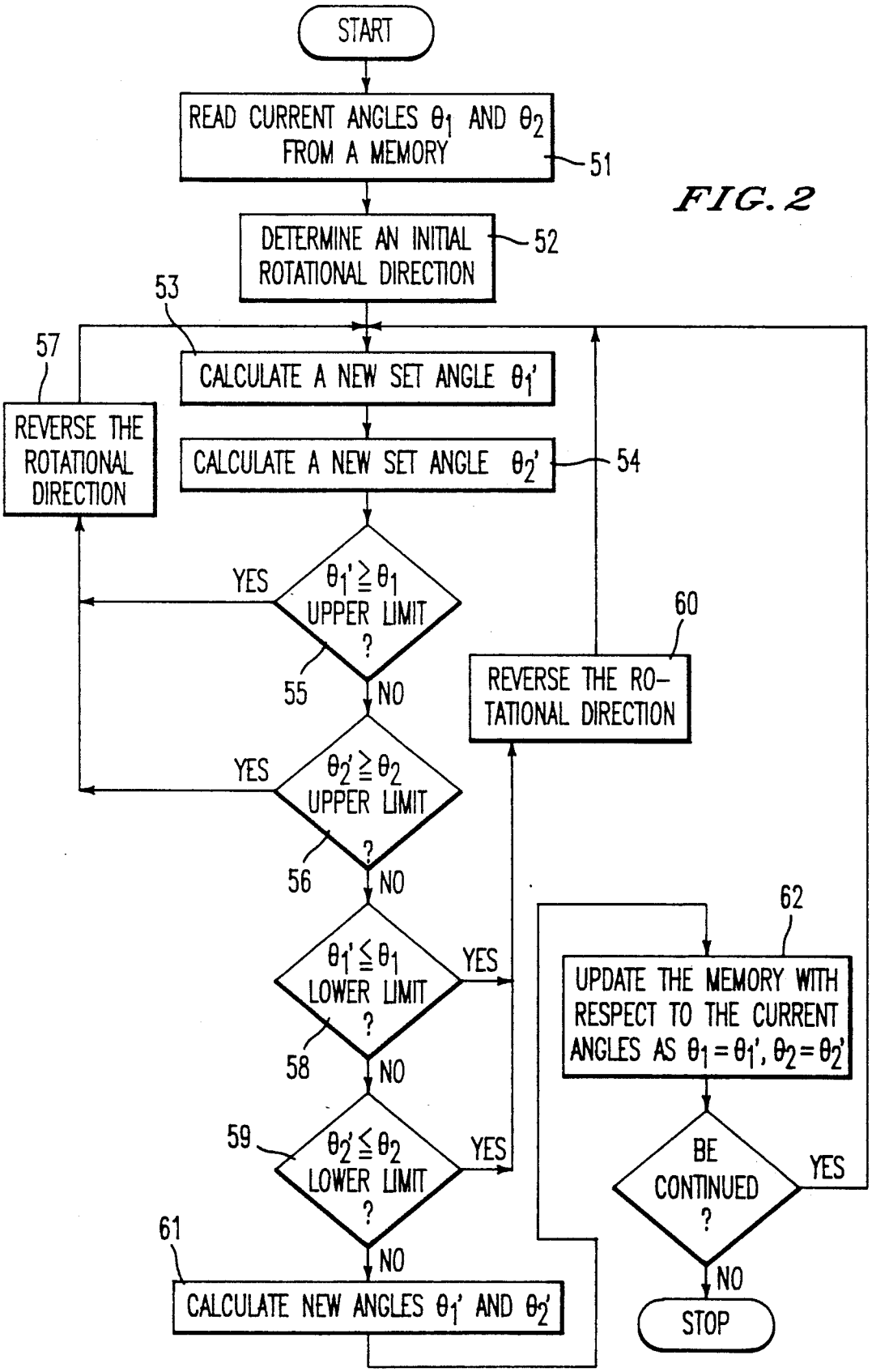
FIG. 2 is a flowchart showing the operations of the blowing direction control device according to the first embodiment.
Figure 6:
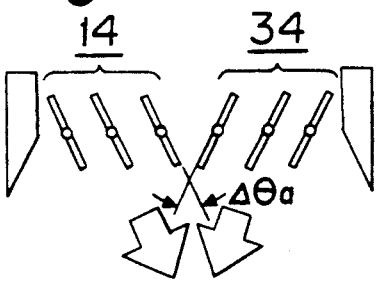
FIG. 6 is a schematic diagram showing an operation of the conventional blowing direction control device.
Figure 7:
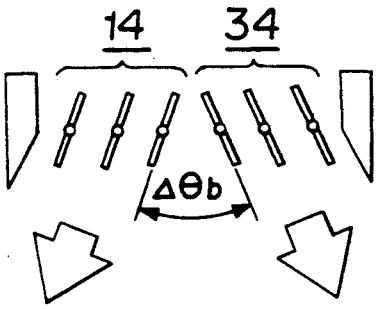
FIG. 7 is a schematic diagram showing another operation of the conventional blowing direction control device.

The operation of the first embodiment will be explained, referring to a flow chart for blowing direction adjustment shown in FIG. 2. When as shown in FIG. 1 the first group 14 and the second group 34 are adjusted to be directed in the same direction indicated by arrows while keeping a phase difference $\Delta\theta$ in blowing direction therebetween, the first rotation angle setting unit 41*a* and the second rotation angle setting unit 41*b* read current angles $\theta 1$ and $\theta 2$ from a memory at Step 51. An initial rotational direction is determined at Step 52. The first rotation angle setting unit 41*a* calculates a new set angle $\theta 1'$ at Step 53. The second rotation angle setting unit 41*b* calculates a new set angle $\theta 2'$ at Step 54. Then the first rotation angle limit detection unit 42*a* compares the angle $\theta 1'$ with $\theta 1$ upper limit at Step 55. Similarly, the second rotation angle limit detection unit 42*b* compares the angle $\theta 2'$ with $\theta 2$ upper limit at Step 56. If $\theta 1' \geqq \theta 1$ upper limit, or $\theta 2' \geqq \theta 2$ upper limit, the rotational direction reversion commanding unit 43 reverses the rotational direction of the blowing direction deflecting plates of the first group 14 and the second group 34 at the Step 57, and calculates new set angles again. On the other hand, if $\theta 1' < \theta 1$ upper limit, or $\theta 2' < \theta 2$ upper limit, similar comparison is made with respect to $\theta 1$ lower limit and $\theta 2$ lower limit at Steps 58 and 59. If $\theta 1' \leqq \theta 1$ lower limit, or $\theta 2' \leqq \theta 2$ lower limit, the rotational direction reversion commanding unit 43 reverses the rotational direction of the blowing direction deflecting plates of the first group 14 and the second group 34 at Step 60, and calculates new set angles again. Unless these inequalities hold, the electric motors 11 and 31 are driven to change the angles to new ones at Step 61, and the memory is updated with respect to the current angles as $\theta 1 = \theta 1'$ and $\theta 2 = \theta 2'$ at Step 62. In such manner, the first group 14 and the second group 34 can reverse their rotational direction while keeping the phase difference $\Delta\theta$ when the rotation angle of either of the first group 14 and the second group 34 has reached the rotation angle upper limit or the rotation angle lower limit. This arrangement can adjust the blowing direction of conditioned air in the horizontal direction in such a way to keep an arbitrary phase difference in accordance with conditions. For example, as shown in FIG. 6, the phase difference $\Delta\theta a$ can set to contract diffused air, thereby allowing hot air to reach a user's feet to positively warm the feet. As shown in FIG. 7, the phase difference $\Delta\theta b$ can be set to spread the diffused air to decrease a feeling of air flow.

In accordance with the first embodiment, the blowing direction of conditioned air can be adjusted while constantly keeping an arbitrary phase difference in blowing direction between a plurality of groups of the blowing direction deflecting plates.

Figure 3:
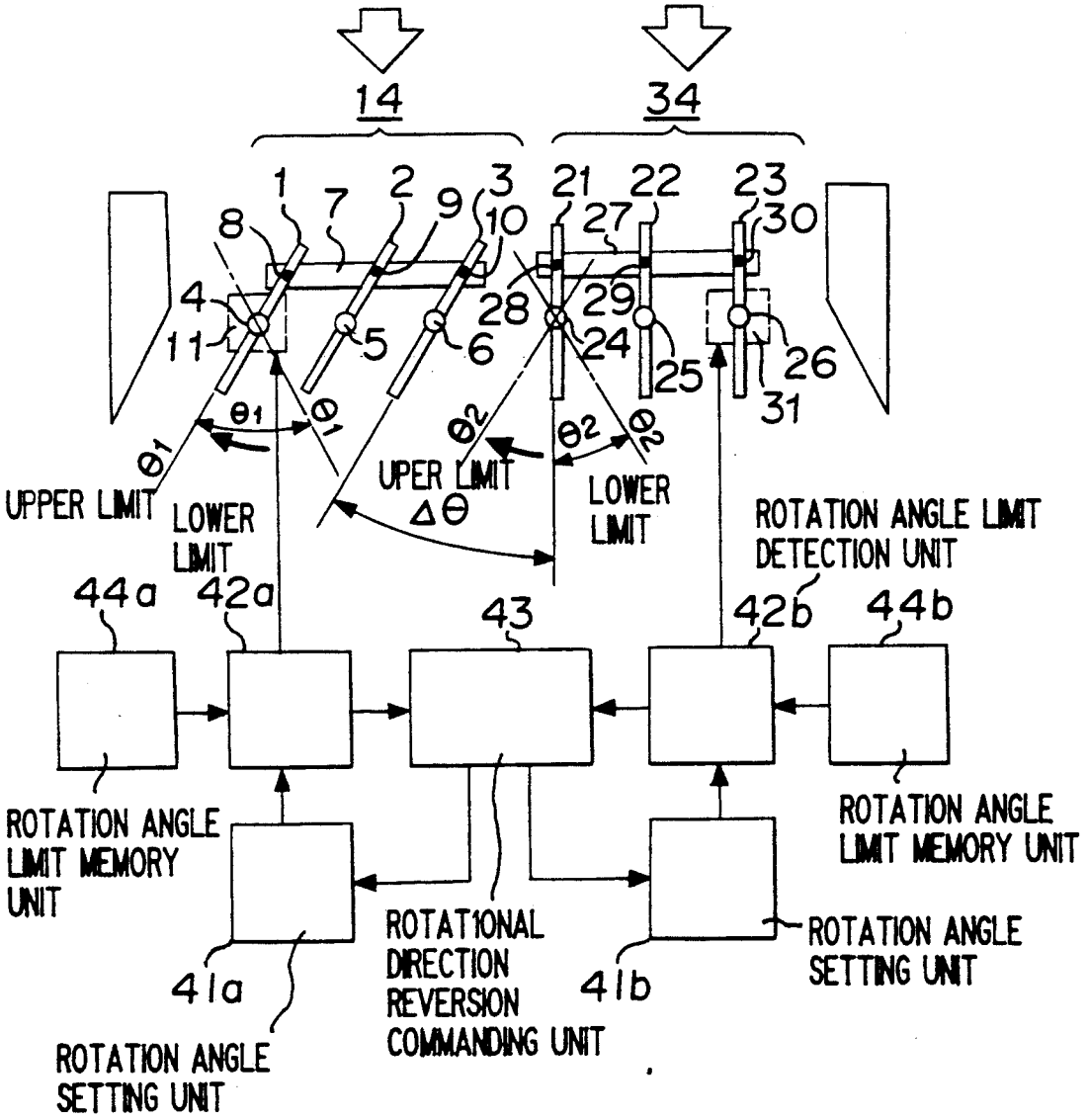
FIG. 3 is a schematic diagram showing the blowing direction control device according to a second embodiment.
Figure 4:
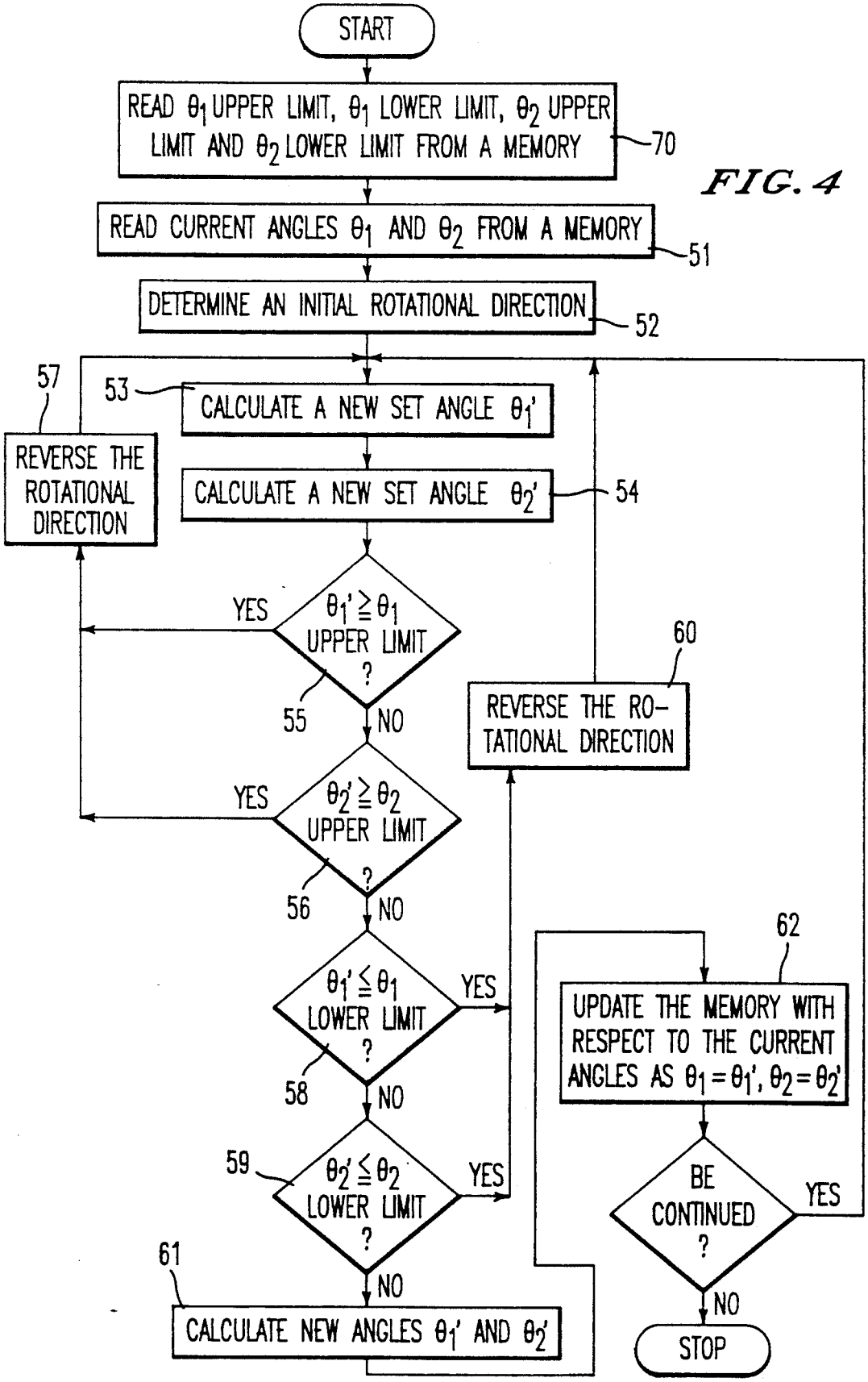
FIG. 4 is a flowchart showing the operations of the blowing direction control device according to the second embodiment.

EMBODIMENT 2:

Referring now to FIGS. 3 and 4, there are shown a second embodiment of the present invention. As shown in FIG. 3, the second embodiment includes a first rotation angle limit memory unit 44*a* and a second rotation angle limit memory unit 44*b* which can change a rotation angle upper limit and a rotation angle lower limit in accordance with the operating conditions of the air conditioner. As shown in a flowchart of FIG. 4, when blowing direction adjustment starts, the first rotation angle limit detection unit 42*a* and the second rotation angle limit detection unit 42*b* read rotation angle upper limits and rotation angle lower limits from the rotation angle limit memory units 44*a* and 44*b*, respectively, at step 70. After that, operations similar to those of the first embodiment will be carried out. In that manner, blowing direction adjustment can be made up to the rotation angle limits in accordance with the operating conditions such as heating, and cooling, thereby expanding a control range of comfort.

In accordance with the second embodiment, a suitable limiting rotation angle can be set in accordance with the operating conditions.

We claim:

1. An air conditioner blowing direction control device comprising:

a plurality of groups (14, 34) which are arranged in an outlet of a main body, and which comprise blowing direction deflecting plates (1, 2, 3) and (21, 22, 23);

rotation angle setting means (41*a*, 41*b*) which are provided for the respective groups (14, 34), and which set rotation angles of the groups (14, 34);

rotation angle limit detection means (42*a*, 42*b*) for comparing preset limiting rotation angles of the groups (14, 34) to the set rotation angles; and rotational direction reversing means (43) for reversing the rotational directions of the groups (14, 34) when at least one of the groups has reached the limiting rotation angle.

2. An air conditioner blowing direction control device according to claim 1, further comprising limiting rotation angle storing means (44*a*, 44*b*) for storing a plurality of limiting rotation angles.

* * * * *